US008158902B2

(12) United States Patent
Valerio

(10) Patent No.: US 8,158,902 B2
(45) Date of Patent: Apr. 17, 2012

(54) METHOD AND APPARATUS FOR SORTING METAL

(75) Inventor: Thomas A. Valerio, Stone Mountain, GA (US)

(73) Assignee: Thomas A. Valerio, Stone Mountain, GA (US)

( * ) Notice: Subject to any disclaimer, the term of this patent is extended or adjusted under 35 U.S.C. 154(b) by 0 days.

(21) Appl. No.: 12/720,509

(22) Filed: Mar. 9, 2010

(65) Prior Publication Data

US 2010/0224537 A1 Sep. 9, 2010

Related U.S. Application Data

(63) Continuation of application No. 11/255,850, filed on Oct. 21, 2005, now Pat. No. 7,674,994.

(60) Provisional application No. 60/621,125, filed on Oct. 21, 2004.

(51) Int. Cl.
*B07C 5/344* (2006.01)

(52) U.S. Cl. ..... 209/571; 209/559; 209/556; 209/557; 209/558; 209/570

(58) Field of Classification Search ..... 209/556, 209/557, 558, 559
See application file for complete search history.

(56) References Cited

U.S. PATENT DOCUMENTS

| | | | | |
|---|---|---|---|---|
| 2,587,686 | A | | 3/1952 | Robert |
| 3,448,778 | A | | 6/1969 | Ramsay |
| 3,490,702 | A | | 1/1970 | Dore |
| 3,568,839 | A | | 3/1971 | Dunlea |
| 3,588,686 | A | | 6/1971 | Gold |
| 3,670,969 | A | | 6/1972 | Terada |
| 3,701,419 | A | | 10/1972 | Hutter et al. |
| 3,702,133 | A | | 11/1972 | Vibert et al. |
| 3,702,682 | A | | 11/1972 | Williams |
| 3,905,556 | A | | 9/1975 | Drage |
| 3,975,263 | A | | 8/1976 | Elo |
| 4,317,521 | A | | 3/1982 | Clark et al. |
| 4,362,276 | A | | 12/1982 | Morey |
| 4,387,019 | A | | 6/1983 | Dale |
| 4,405,451 | A | | 9/1983 | Roman |
| 4,541,530 | A | | 9/1985 | Kenny et al. |
| 4,557,386 | A | | 12/1985 | Buckley et al. |
| 4,563,644 | A | | 1/1986 | Lenander et al. |
| 4,576,286 | A | | 3/1986 | Buckley et al. |
| 4,597,487 | A | * | 7/1986 | Crosby et al. ..... 194/209 |

(Continued)

FOREIGN PATENT DOCUMENTS

| | | |
|---|---|---|
| DE | 4306781 | 9/1994 |

(Continued)

OTHER PUBLICATIONS

Hottenstein. Beyond Density. Recycling Today [online]. Nov. 18, 2008, http://www.recyclingtoday.com/Article.aspx?article_id=21468.

(Continued)

*Primary Examiner* — Terrell Matthews
(74) *Attorney, Agent, or Firm* — King & Spalding

(57) ABSTRACT

A system for sorting metals from a batch of mixed material scrap includes an array of inductive proximity detectors, a processing computer and a sorting mechanism. The inductive proximity detectors identify the location of the metal pieces and the processing computer instructs the sorting mechanism to place the metal and non-metallic pieces into separate containers.

8 Claims, 5 Drawing Sheets

U.S. PATENT DOCUMENTS

| | | | | | |
|---|---|---|---|---|---|
| 4,718,559 | A | | 1/1988 | Kenny et al. | |
| 4,724,384 | A | | 2/1988 | Castovilly et al. | |
| 4,848,590 | A | | 7/1989 | Kelly | |
| 4,851,110 | A | | 7/1989 | Rolle et al. | |
| 4,933,075 | A | | 6/1990 | Nordin | |
| 4,940,187 | A | | 7/1990 | Lee | |
| 4,986,410 | A | * | 1/1991 | Shields | 198/444 |
| 5,000,390 | A | | 3/1991 | Marrs | |
| 5,022,985 | A | | 6/1991 | Nugent | |
| 5,025,929 | A | | 6/1991 | Careera | |
| 5,139,150 | A | * | 8/1992 | Fuller et al. | 209/576 |
| 5,148,993 | A | | 9/1992 | Kashiwagi | |
| 5,169,073 | A | | 12/1992 | Marabini | |
| 5,209,355 | A | | 5/1993 | Mindermann | |
| 5,260,576 | A | | 11/1993 | Sommer | |
| 5,273,166 | A | | 12/1993 | Sawamura | |
| 5,314,071 | A | | 5/1994 | Christian | |
| 5,314,072 | A | | 5/1994 | Frankel | |
| 5,335,791 | A | | 8/1994 | Eason | |
| 5,341,935 | A | | 8/1994 | Djerf et al. | |
| 5,344,025 | A | | 9/1994 | Tyler et al. | |
| 5,344,026 | A | | 9/1994 | Booth et al. | |
| 5,413,222 | A | | 5/1995 | Holder | |
| 5,433,157 | A | | 7/1995 | Dittmann et al. | |
| 5,443,157 | A | | 8/1995 | Baker et al. | |
| 5,465,847 | A | | 11/1995 | Gilmore | |
| 5,468,291 | A | | 11/1995 | Waterson et al. | |
| 5,502,559 | A | | 3/1996 | Powell et al. | |
| 5,512,758 | A | | 4/1996 | Kobayashi et al. | |
| 5,535,891 | A | | 7/1996 | Kuniyone | |
| 5,548,214 | A | | 8/1996 | Yasohama | |
| 5,555,324 | A | | 9/1996 | Waxman et al. | |
| 5,555,984 | A | | 9/1996 | Sommer | |
| 5,562,743 | A | | 10/1996 | Daugherty | |
| 5,611,493 | A | | 3/1997 | Hayashi et al. | |
| 5,624,525 | A | | 4/1997 | Ehara et al. | |
| 5,628,409 | A | | 5/1997 | Thomas | |
| 5,632,381 | A | | 5/1997 | Thust et al. | |
| 5,667,151 | A | | 9/1997 | Miura et al. | |
| 5,678,775 | A | | 10/1997 | Chapman | |
| 5,739,524 | A | | 4/1998 | Fally | |
| 5,791,489 | A | * | 8/1998 | Leifeld | 209/44.1 |
| 5,801,530 | A | | 9/1998 | Crosby | |
| 5,829,600 | A | | 11/1998 | Jordan et al. | |
| 5,829,694 | A | | 11/1998 | Chapman | |
| 6,100,488 | A | | 8/2000 | Satake et al. | |
| 6,112,903 | A | | 9/2000 | Kimmel | |
| 6,124,560 | A | | 9/2000 | Roos | |
| 6,144,004 | A | | 11/2000 | Doak | |
| 6,191,580 | B1 | | 2/2001 | Guichard | |
| 6,199,779 | B1 | | 3/2001 | Mosher | |
| 6,313,422 | B1 | | 11/2001 | Anibas | |
| 6,420,866 | B1 | | 7/2002 | Goldberg et al. | |
| 6,452,396 | B2 | | 9/2002 | Ott | |
| 6,497,324 | B1 | | 12/2002 | Doak | |
| 6,568,612 | B1 | | 5/2003 | Aoki | |
| 6,669,839 | B2 | | 12/2003 | Tipton et al. | |
| 6,696,655 | B2 | | 2/2004 | Harbeck et al. | |
| 6,838,886 | B2 | | 1/2005 | Hilliard | |
| 6,914,678 | B1 | | 7/2005 | Ulrichsen et al. | |
| 6,984,767 | B2 | | 1/2006 | Hunt | |
| 7,173,411 | B1 | | 2/2007 | Pond | |
| 7,296,340 | B2 | | 11/2007 | Sakaida et al. | |
| 7,351,376 | B1 | | 4/2008 | Quake et al. | |
| 7,351,929 | B2 | | 4/2008 | Afsari et al. | |
| 7,354,733 | B2 | | 4/2008 | Bukshpan et al. | |
| 7,449,655 | B2 | | 11/2008 | Cowling | |
| 7,674,994 | B1 | | 3/2010 | Valerio | |
| 7,786,401 | B2 | | 8/2010 | Valerio | |
| 2001/0045378 | A1 | | 11/2001 | Charles et al. | |
| 2002/0074274 | A1 | | 6/2002 | Pegga | |
| 2004/0144693 | A1 | | 7/2004 | Tse | |
| 2005/0242006 | A1 | | 11/2005 | Bohlig et al. | |
| 2006/0219276 | A1 | | 10/2006 | Bohnert | |
| 2007/0045158 | A1 | | 3/2007 | Johnson | |
| 2007/0084757 | A1 | | 4/2007 | Jeon et al. | |
| 2007/0098625 | A1 | | 5/2007 | Adams | |
| 2007/0187299 | A1 | | 8/2007 | Valerio | |
| 2007/0262000 | A1 | | 11/2007 | Valerio | |
| 2008/0257794 | A1 | | 10/2008 | Valerio | |
| 2009/0250384 | A1 | | 10/2009 | Valerio | |
| 2010/0005926 | A1 | | 1/2010 | Valerio | |

FOREIGN PATENT DOCUMENTS

| | | |
|---|---|---|
| EP | 0332564 | 9/1989 |
| EP | 0541403 | 5/1993 |
| SU | 1039567 | 9/1983 |
| SU | 1606208 | 11/1990 |
| WO | WO 2006/131377 | 12/2006 |
| WO | 2009067570 | 5/2009 |
| WO | WO 2004/657570 | 5/2009 |

OTHER PUBLICATIONS

Goosey et al. A Scoping Study: End-of-Life Printed Circuit Boards [online]. 2002, http://cfsd.org.ukiseeba/TD/reports/PCB_ Study. pdf.

* cited by examiner

METHOD AND APPARATUS FOR SORTING METAL

CROSS-REFERENCE TO RELATED APPLICATIONS

This application is a continuation of U.S. patent application Ser. No. 11/255,850, entitled "Method and Apparatus for Sorting Metal Pieces," filed Oct. 21, 2005, now U.S. Pat. No. 7,674,994, which claims the benefit of priority under 35 U.S.C. 119 to U.S. Provisional Application No. 60/621,125 filed Oct. 21, 2004, the complete disclosure of the above-identified priority applications is hereby incorporated herein by reference.

BACKGROUND

Recyclable metal accounts for a significant share of the solid waste generated. It is highly desirable to avoid disposing of metals in a landfill by recycling metal objects. In order to recycle metals from a mixed volume of waste, the metal pieces must be identified and then separated from the non-metallic pieces.

SUMMARY OF THE INVENTION

The present invention is a system for sorting metal from a group of mixed material pieces with a group of proximity sensors. The mixed materials containing the metal are placed on a moving conveyor belt or slide down an inclined smooth surface. A number of inductive proximity sensors are placed in an array across the path of the mixed materials. The sensors generate a signal when a metal piece is detected.

In an embodiment, different types of proximity sensors are used to detect different types of metal pieces. Unshielded proximity sensors are very good at detecting large metal pieces an shielded proximity sensors are better at detecting smaller metal pieces. In order to perform the sorting process, each piece must be moved within the range of at least one of the sensors. The sensors have a limited range of detection so a plurality of sensors are placed in a configuration that spans a path that all of the mixed pieces passed through. In an embodiment, the mixed pieces are placed on a conveyor belt that moves the pieces past sensors that are mounted across the width of the conveyor belt. The sensors may be mounted above and/or below the conveyor belt.

The sensors are coupled to a computer that controls a sorting system. In an embodiment, the sorting system includes an array of controllable air jets mounted at the end of the conveyor belt. When the metal piece is detected, the computer synchronizes the actuation of the air jet with the time that the metal piece reaches the end of the conveyor belt. The air jet causes the metal piece to fall into a metal piece bin. The air jets are not actuated when non-metallic pieces reach the end of the conveyor belt and fall into a bin containing non-metallic pieces. The sorted metal pieces can then be recycled or resorted to separate the different types metals.

DETAILED DESCRIPTION

Figure 1:
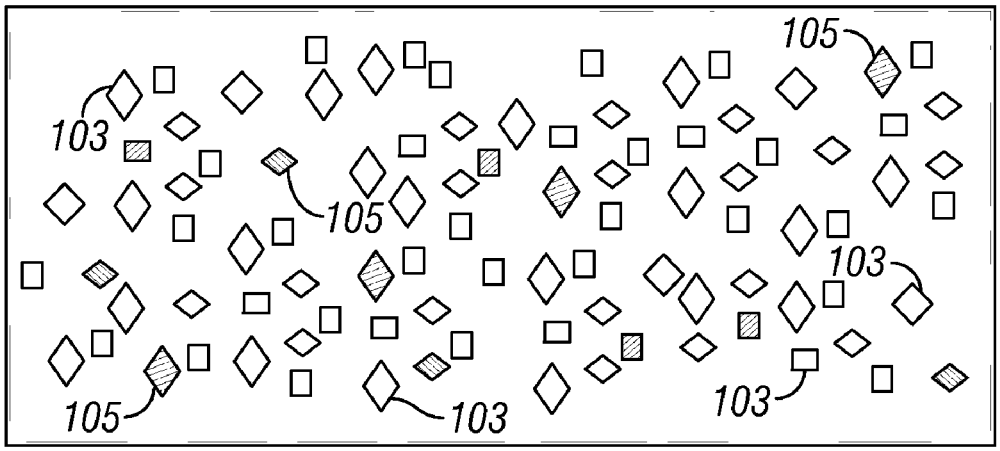
FIG. 1 illustrates a conveyor belt for transporting mixed media.

There are various methods for separating and recycling waste metal from a group of mixed material waste pieces. For example, the ferrous metal components can be sorted from non-ferrous metals, plastic and glass by magnetic filtration. The non-ferrous metals can be sorted from plastic and glass by known eddy current methods. Other metal sensors can be used to remove the other non-conducting metals that may have been missed by the eddy current device. The plastic and rubber are much lower in density than the glass so the density sorting methods are used to remove the plastic pieces from the metal and glass. An example of a density sorting system is a media flotation system, the pieces to be sorted are immersed in a fluid having a specific density such as water. The plastic and rubber may have a lower density and float to the top of the fluid, while the heavier metal and glass components will sink.

Other recycling systems detect and separate the metal pieces from the mixed material parts. The metal pieces are detected with inductive proximity detectors. The proximity detector comprises an oscillating circuit composed of a capacitance C in parallel with an inductance L that forms the detecting coil. An oscillating circuit is coupled through a resistance Rc to an oscillator generating an oscillating signal S1, the amplitude and frequency of which remain constant when a metal object is brought close to the detector. On the other hand, the inductance L is variable when a metal object is brought close to the detector, such that the oscillating circuit forced by the oscillator outputs a variable oscillating signal S2. It may also include an LC oscillating circuit insensitive to the approach of a metal object, or more generally a circuit with similar insensitivity and acting as a phase reference.

Oscillator is powered by a voltage V+ generated from a voltage source external to the detector and it excites the oscillating circuit with an oscillation with a frequency f significantly less than the critical frequency fc of the oscillating circuit. This critical frequency is defined as being the frequency at which the inductance of the oscillating circuit remains practically constant when a ferrous object is brought close to the detector. Since the oscillation of the oscillating circuit is forced by the oscillation of oscillator the result is that bringing a metal object close changes the phase of S2 with respect to S1. Since the frequency f is very much lower than the frequency fc, the inductance L increases with the approach of a ferrous object and reduces with the approach of a non-ferrous object. From U.S. Pat. No. 6,191,580 which is hereby incorporated by reference. An example of this oscillator type inductive proximity detector is the Contrinex series 500 units.

Different types of inductive proximity detectors are available which have specific operating characteristics. In particular shielded and unshielded inductive proximity detectors perform the same operation of detecting metal but have distinct operating characteristics which are listed in Table 1.

TABLE 1

| | Shielded Inductive Proximity Detector | Unshielded Inductive Proximity Detector |
|---|---|---|
| Operating Frequency | ~100 Hz | ~300 Hz |
| Resolution | ~25 mm at 2.5 mps | ~8.325 mm at 2.5 mps |
| Penetration | 40 mm | 22 mm |
| Diameter | ~30 mm | ~30 mm |
| Detection Time | ~10 ms per cycle | ~3.33 ms per cycle |
| Belt Speed | 0 to 4 mps | 0 to 4 mps |

The operating frequency corresponds to the detection time and operating speed of the metal detection. A faster operating frequency will be able to detect metal objects more quickly than a detector with a slower operating frequency. The resolution corresponds to the size of the object being detected. A detector having a larger resolution is more suitable for detecting large metal objects than a detector having a smaller resolution. The penetration refers to the maximum thickness of non-metallic material that can cover the metal object that the detector can penetrate and still properly detecting the underlying metal. This is important if there is non-metallic material over the metal. A detector having a higher penetration depth will be able to penetrate the non-metallic material and detect more metal pieces than a detector having a lower penetration depth. Based upon the performance characteristics unshielded inductive proximity detectors are more suitable for detecting larger metal pieces (specify size range) while the shielded inductive proximity detectors are better at detecting smaller metal pieces. The Contrinex, Condet 500 series includes both shielded and unshielded sensors.

The specifications in Table 1 are for typical 30 mm diameter inductive proximity detectors. It is possible to modify the design by changing the diameter which results in changed operating characteristics. In particular, the penetration distance can be lengthened by enlarging the diameter of the sensor. The larger detection area can result in slower detection time and may be more susceptible to cross talk.

In addition to inductive proximity sensors that detect small and large pieces of metal, there are other special sensors that have special detector capabilities. For example, coil based inductive proximity sensors are able to accurately detect non-ferrous metals such as aluminum, brass, zinc, magnesium, titanium, and copper. Depending upon the metal detection application, the material specific inductive proximity detectors can be used with the other sensors to detect large and small ferrous metal pieces and non-ferrous metal pieces. The non-ferrous metal detectors can be intermixed in the array of shielded and unshielded sensors or added as additional rows of non-ferrous metal detectors to the array. The Contrinex, Condet 700 series is an example of a coil based inductive proximity detector that has a substantially uniform correction factor for many non-ferrous metals.

Although inductive proximity detectors can detect the presence of various types of metals, this ability can vary depending upon the sensor and the type of metal being detected. The distinction in sensitivity to specific types of metals can be described in various ways. One example of the variation in sensitivity based upon the type of metal being detected is the correction factor which is the method used by Contrinex. All Contrinex inductive proximity sensors have "correction factors" which quantifies the relative penetration distance for various metals. By knowing the base penetration distance (specified in Table 1) and the correction factor of the metal being detected, the penetration distance for any metal being detected can be determined. Typical correction factors for an inductive proximity detector may be that listed in Table 2 below.

TABLE 2

| METAL | CORRECTION FACTOR |
|---|---|
| Steel | 1.00 |
| Aluminum | 0.50 |
| Brass | 0.45 |
| Copper | 0.40 |
| Nickel-Chromium | 0.90 |
| Stainless Steel | 0.85 |

In this example the detector has a penetration rating of 40 mm and an aluminum correction factor of 0.50. The penetration rating for aluminum would be the correction factor 0.50 multiplied by the penetration rating 40 mm. Thus, the penetration depth for aluminum for the detector is 20 mm. In some cases the detector may have a very small correction factor, i.e., less than 0.10 for certain types of metals and cannot detect these metals. Conversely, a detector that has a correction factor greater than 1.00 will be more sensitive to this metal than it is to steel.

Figure 2:
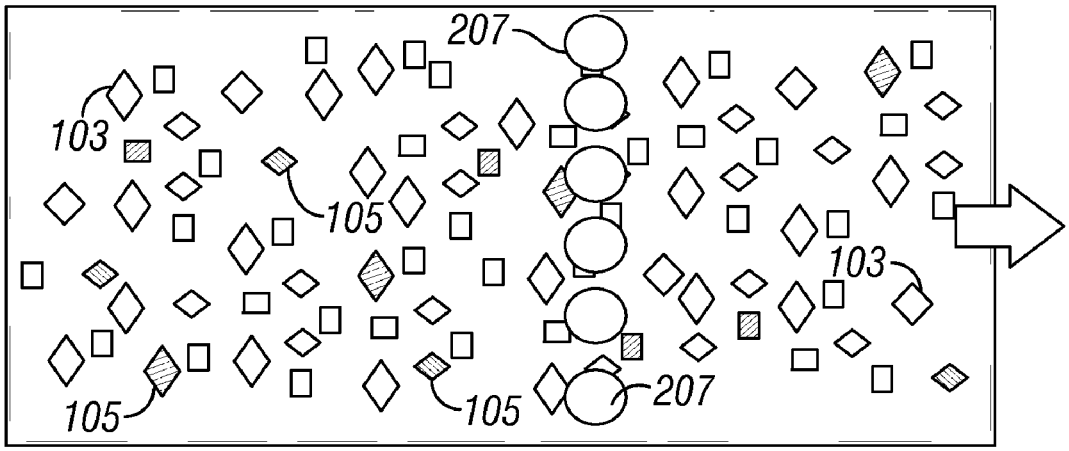
FIG. 2 illustrates a group of sensors mounted arranged in a linear array.

In order to accurately detect the metal pieces mixed in with the non-metallic pieces, the detectors must be placed in close proximity to determine the material of the piece being inspected. This can be done by distributing the mixed pieces on a surface in a manner that the pieces are not stacked on top of each other a there is some space between the pieces. The batch of mixed materials can be moved under one or more detectors or alternatively the pieces can be moved over the detector(s). The detection is based upon the size and material of the metal as discussed in Contrinex inductive proximity detector literature that is attached. Rather than passing all of the mixed material pieces in close proximity to the detector a more efficient system uses multiple detectors. For example, with reference to FIG. 2, a number of detectors 207 may be arranged in a linear one dimensional array across a width of a conveyor belt 201 transporting the mixed material pieces 103, 105. This configuration allows the metal pieces 105 to be detected by moving the mixed pieces across the row of detectors 207 which substantially speeds the metal detection process.

Because the detection range of the metal detectors is short, they must be positioned close to each other so that all metal pieces passing across the array of sensors are detected. The metal pieces should not be able to pass between the sensors and avoid being detected. Although it is desirable to place the detectors close to each other, a problem with closely spaced detectors is cross talk. Cross talk is a condition in which metal detection signals intended to be detected by one sensor may detected by other adjacent detectors.

Figure 3:
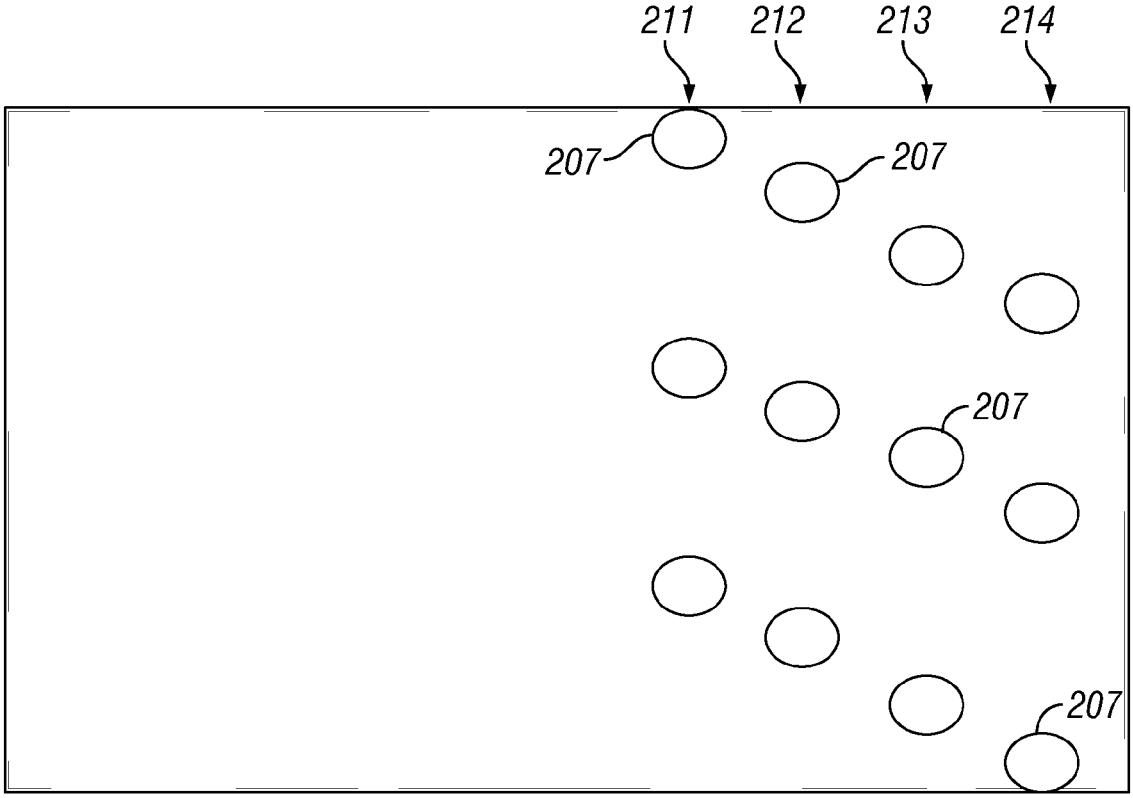
FIG. 3 illustrates a group of sensors arranged in a multi-row staggered array.

There are various methods for avoiding the cross talk problem between the detectors while covering the entire width of the conveyor belt. With reference to FIG. 3, the sensors can be staggered such that the sensors are not positioned close to each other yet any metal piece on the conveyor belt will pass close to at least one sensor. When using a staggered configuration, the sensors may be setup in multiple rows of sensors 207. By having more rows of sensors 207, the spacing between each sensor 207 can be extended to avoid cross talk. In an embodiment, four or more staggered rows 211, 212, 213, 214 of sensors 207 may be used. By placing these sensors 207 in four or more staggered rows, the sensors 207 are sufficiently spaced apart from each other to avoid any cross talk. This technique is particularly useful when used with non-oscillating type inductive proximity sensor. The Contrinex Condet series 700 is an example of a coil/non-oscillating type inductive proximity sensor.

Figure 4:
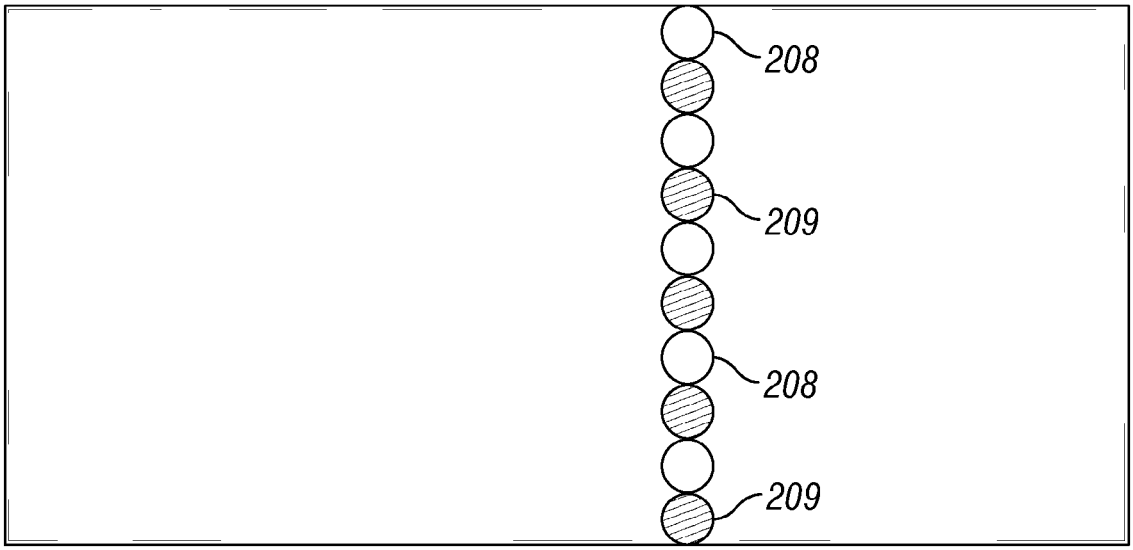
FIG. 4 illustrates two types of sensors arranged in a linear configuration.

Another means for avoiding cross talk is by using sensors having different operating frequencies. Cross talk can only occur between sensors operating at the same frequency. With reference to FIG. 4, by placing sensors operating at different frequencies next to each other in the one dimensional array there is greater separation of same frequency sensors. If two different frequency sensors are used, an f1 detector 208 having a first frequency is placed next to an f2 detector 209 having a second frequency. These detectors 208, 209 are followed by an alternating pattern. This alternating pattern can be used with more than 2 different sensor frequencies for even further separation of the potentially cross talking sensors. This mixed frequency solution is useful for inductive proximity detectors that can be manufactured with multiple frequencies such as the Contrinex, Condet Series 500. In contrast, coil based detectors such as the Contrinex, Condet Series 700 do not have oscillators which can be operated at different frequencies and cannot be arranged in alternating frequencies to avoid cross talk.

Figure 5:
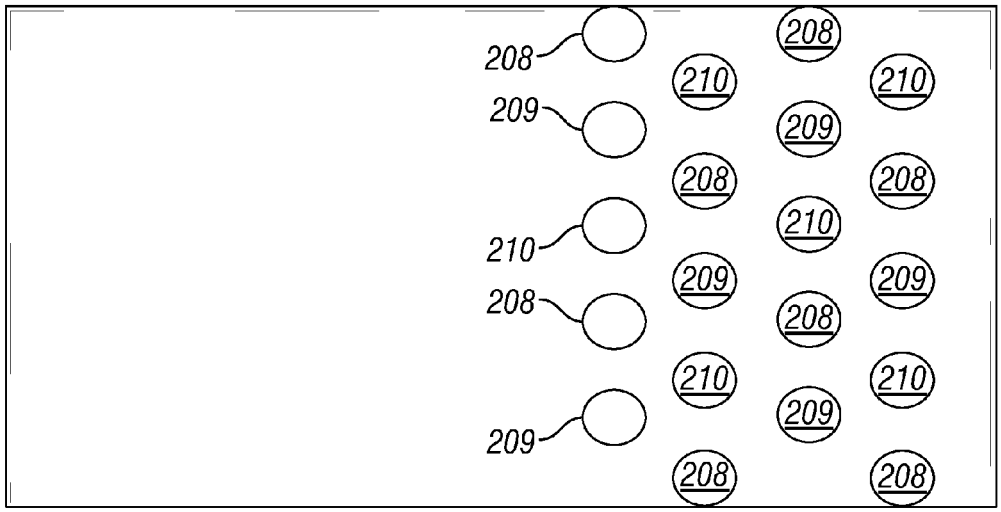
FIG. 5 illustrates a group of sensors arranged in a staggered configuration.

With reference to FIG. 5, it is also possible to combine alternating of frequencies and separation of the sensors into one or more additional staggered rows of detectors. A first set of sensors 208 operates at a first frequency, a second set of sensors 209 operates at a second frequency, and a third set of sensors 210 operates at a third frequency. By using different frequencies and/or using multiple staggered rows of sensors, detectors 208, 209, 210 can be placed across the entire width of the inspection area without causing cross talk problems.

Figure 6:
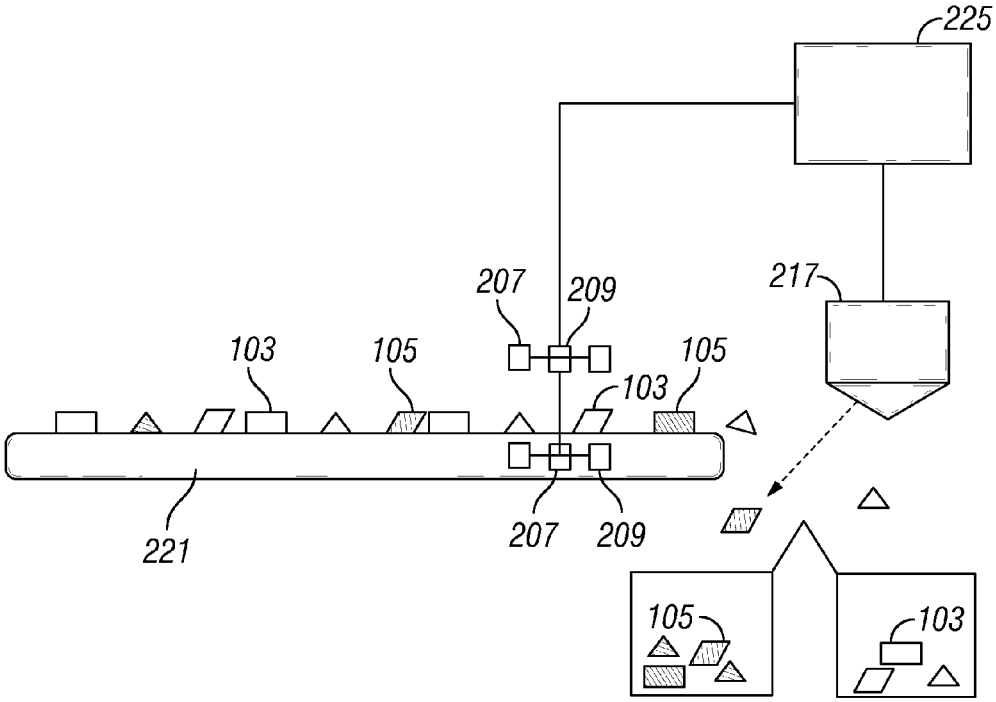
FIG. 6 illustrates a side view of the conveyor belt with a metal sorting system.

As discussed above, unshielded detectors are suitable for detecting large pieces while shielded detectors work better with small pieces. Thus, the small and large metal pieces can be most efficiently sorted from the mixed materials by using both shielded and unshielded inductive proximity sensors. With reference to FIG. 6, a side view of an embodiment of the inventive sorting system is shown. In order to quickly and accurately detect all sizes of metal pieces, the mixed materials pieces 103, 105 should be passed in close proximity to at least one shielded sensor 207 and one unshielded sensor 209. The conveyor belt 221 should be thin and not contain any carbon material so that sensors 207, 209 mounted under the conveyor belt 221 can detect the metal pieces 105 resting on top of the conveyor belt 221. In the preferred embodiment, the conveyor belt 221 is a thin layer of urethane which provides a non-slip surface for the mixed material pieces 103, 105 and allows the pieces to be moved closely over the proximity detectors 207, 209 without any physical contact.

Flat pieces of metal 105 will lie flat on the conveyor belt during the metal detection process. Thus, these flat pieces of metal 105 pass closely by the inductive proximity detectors 207, 209 mounted under the conveyor belt 221 and are easily detected. If however, the metal piece 105 is bent and only a few sections rest on the belt 221, it may be difficult for the sensors under the belt 221 to detect the metal piece 105. In order to detect these bent metal pieces 105, additional sensors 207, 209 are placed above the conveyor belt 221 facing down onto the mixed materials 103, 105. These upper sensors 207, 209 can be arranged in the same manner as the sensors 207, 209 under the belt. The same problems with regard to cross talk are applicable to the upper sensors 207, 209 and the same solutions to this problem can be implemented: staggered configuration, multiple frequency sensors, etc., as described above.

The inventive metal sorting system can use shielded induction proximity sensors 207, unshielded induction proximity sensors 209 or a combination of shielded and unshielded sensors 207, 209. In any of these configurations, all signals from the detectors 207, 209 are fed to a processing computer 225. Because the shielded sensors 207 and the unshielded sensors 209 are each better at identifying specific types of metal pieces 105, they will produce different detection signals for the same piece of metal 105. Because shielded sensors 207 are better at detecting small pieces, they will produce a stronger detection signal for a small metal piece than an unshielded sensor 209. Similarly, the unshielded sensor 209 will produce a stronger detection signal for a larger metal piece than the shielded sensor 207. In order to improve the accuracy of the metal identification process, the processing computer 225 may have an algorithm that uses the strongest detector signal to indicate the position of the detected metal piece 105. In this embodiment, the mixed pieces 103, 105 can be passed by several rows of sensors 207, 209 so that the metal pieces 105 are detected several times. The system will be more accurate because the position of the metal piece 105 will be tracked by the detectors 207, 209 and the strongest detection signal will provide the most accurate position information.

As discussed above, the unshielded sensors are slower than the shielded sensors and require more time to accurately detect the metal pieces. The detectors can be configured with multiple rows of shielded sensors and fewer rows of unshielded sensors. By having additional rows of shielded sensors, it is more likely that at least one of the several rows of shielded sensors will detect the metal pieces.

The described sensor arrays may be placed under the conveyor belt and/or over the conveyor belt. In a normal configuration, the sensor arrays are placed under the conveyor belt. With the sensors just under the moving conveyor belt and the parts resting on conveyor belt pass close by the sensors and are easily detected.

In some situations, the metal pieces may not rest flat on the conveyor belt. For example, when the mixed pieces are placed on the conveyor belt, a small metal piece may be on top of a large non-metallic piece. In these situations, the sensors under the conveyor belt cannot detect the metal pieces as easily. The detection of these bent metal pieces can be improved by placing sensors both above and below the conveyor belt. Any metal pieces that are on top of a non-metal piece are blocked and the lower sensor under the belt may not detect this metal piece. These metal pieces may only be detected by sensors mounted over the conveyor belt which have a clear view of the metal piece.

With reference to FIG. 1, once these metal pieces 105 have been identified they are then removed from the surface 101 to separate the metal 105 and non-metal 103. The removal process is performed by a mechanical device. For example, a vacuum hose can be positioned over the detected location of the metal 105 with robotic arms and the vacuum can be actuated to remove the metal piece. In alternative embodiments any other method may be used to remove the metal 105, such as: air jets directed at the metal, adhesive contact, grasping with a robotic clamping device, a sweeping mechanism or any other device which can displace the metal. In general, it is more efficient to remove the metal pieces 105 because there is typically more non-metal pieces 103 in the mixed materials. However, it is also possible to remove the non-metal pieces 103. After the metal pieces 105 have been separated from a group of mixed material pieces 103, 105 on a table, the non-metal 103 is removed from the surface and a new batch of mixed material pieces 103, 105 is laid out.

With reference to FIG. 6, a more efficient means of sorting the metal pieces 105 is through an automated system that integrates a moving conveyor belt 221 with an array of inductive proximity sensors 207, a computer 225 and a sorting mechanism. In this embodiment, the mixed material pieces 103, 105 is placed onto the moving conveyor belt 221 which causes the pieces 103, 105 to travel over an array of inductive proximity sensors 207. The inductive proximity sensors 207 may be mounted over and under the conveyor belt 221 and are used to detect position of the metal pieces 105 on the moving belt 221. The detected positions of the metal pieces 105 are fed to the computer 225. By knowing the positions of the metal pieces 105 on the belt and the speed of the conveyor belt 221, the computer 211 can predict the position of the metal pieces 105 at any time after detection. For example, the computer 225 can predict when and where a metal piece 105 will fall off the end of the conveyor belt 221. With this information, the computer 225 can then instruct the sorting mechanism to separate the metal 105 as it falls off the conveyor belt 221.

In order to accurately detect each metal piece 105 on the conveyor belt 221 with short range detectors 207, 209, an array of inductive proximity detectors 207, 209 must be used. This array places detectors 207, 209 evenly across the width of the conveyor belt 221 so that all mixed material pieces on the belt 221 pass closely by at least one of the detectors 207, 209. The array of detectors 207, 209 can be under as well as above the conveyor belt 221. The array of detectors 297, 209 can be arranged in any of the patterns and configurations described above with reference to FIGS. 2-5.

Various sorting mechanisms may be used. Again with reference to FIG. 6, an array of air jets 217 is mounted at the end of the conveyor belt 221. The array of air jets 217 is mounted above the end of the conveyor belt 221 and has multiple air jets mounted across the conveyor belt 221 width. The computer 211 tracks the position of the metal pieces 105 and transmits a control signal to actuate the individual air jet 217 corresponding to the position of the metal pieces 105 as they fall off the end of the conveyor belt 221. The air jets 217 deflect the metal pieces 105 and cause them to fall into a metal collection bin 229. The air jets 217 are not actuated when non-metal pieces 103 fall off the conveyor belt 221 and the non-metal pieces 103 fall off the end of the conveyor belt 221 into a non-metal collection bin 227.

Although the collection bins 227, 229 are shown in FIG. 6 as fixed containers, it is intended that the bins described in the patent application and the terms of the claims can be various other structures. For example, the bins can be movable containers which are used to transport the materials, a feeder mechanism that receives and places the pieces onto additional processing machines. Pieces placed in the bin may then be fed onto the conveyor belts of additional processing machines. It is contemplated that the bins can also be transport mechanisms, trucks, conveyor belts, feeders or any other storage or delivery mechanism.

Again, the array of air jets 217 is just one type of mechanism that can be used to sort the mixed material pieces 103, 105. It is contemplated that various other sorting mechanisms may be used. An array of vacuum hoses may be positioned across the conveyor belt and the computer may actuate a specific vacuum as the metal passes under the corresponding hose. Alternatively, robotic arms with suction, adhesive, grasping or sweeping mechanisms may be used to remove the metal as it moves under a sorting region of the system. An array of small bins may be placed under the end of the conveyor belt and when a metal piece 105 is detected the smaller bin may be placed in the falling path to catch the metal 105 and then retracted. All non-metal 103 would be allowed to fall into a lower bin.

Figure 7:
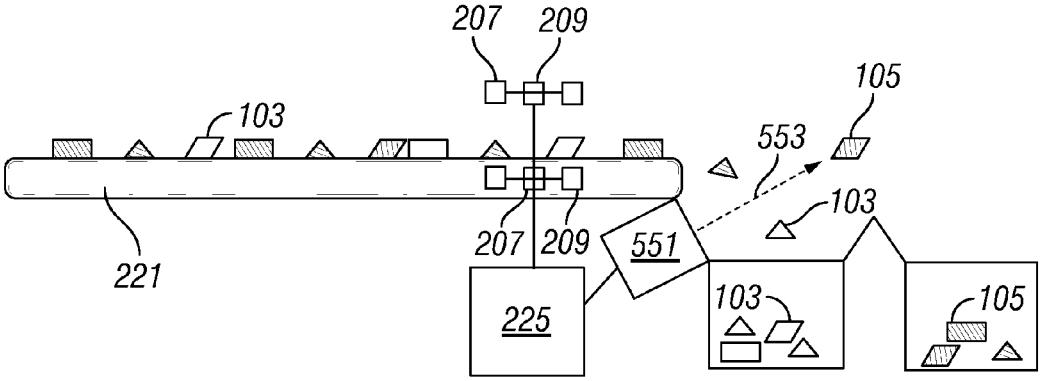
FIG. 7 illustrates a side view of the conveyor belt with a metal sorting system.

It is also possible to have a similar sorting mechanism with an array of jets mounted under the conveyor belt. With reference to FIG. 7, an alternative sorting system includes an array of jets 551 mounted under the conveyor belt 221. The operation of this sorting system is similar to the system described with reference to FIG. 4. The difference between this alternative embodiment is that as the metal pieces 105 fall off the end of the conveyor belt 221, the computer 211 actuates the array of jets 551 to emit air jets 553 that are angled upward to deflect the metal 105 farther away from the end of the conveyor belt 221. This results in the metal being diverted into a metal bin 229 and the non-metal falling into an non-metal bin 227.

Current air jets have operating characteristics that can cause inefficiency in the sorting system. Specifically, because the pieces come across the conveyor belt at high speed, the actuation of the air jets must be precisely controlled. Although the computer may actuate the air valve, there is a delay due to the valve's response time. A typical air valve is connected to 150 psi air and has a Cv of 1.5. While performance is constantly improving, the current characteristics are 6.5 milliseconds to open the air valve and 7.5 milliseconds to close the air valve. The computer can compensate for this delayed response time by calculating when the metal piece will reach the end of the conveyor belt and transmitting control signals that account for the delayed response time of the air valve. This adjustment can be done through computer software. For example, the signal to open the air valve is transmitted 6.5 milliseconds before the piece reaches the end of the conveyor belt and the signal to close the valve 7.5 milliseconds before the air jet should be stopped. With this technique, the sorting of the pieces will be more accurate. Future air valves will have an opening response time of 3.5 milliseconds and a closing response time of 4.5 milliseconds. As the response time of the air valves further improves, this off set in signal timing can be adjusted accordingly to preserve the timing accuracy.

Although the inventive metal sorting system has been described with an array of air jets mounted over or under the conveyor belt, it is contemplated that various other sorting mechanisms can be used. For example, an array of vacuum hoses may be positioned across the conveyor belt and the computer may actuate a specific vacuum tube as the metal pieces pass under the corresponding hose. Alternatively, robotic arms with suction, adhesive, grasping or sweeping mechanisms may be used to remove the metal pieces as they move under a sorting region of the system. An array of small bins may be placed under the end of the conveyor belt and when a metal pieces are detected, the smaller bin may be placed in the falling path to catch the metal and then retracted. In this embodiment, all non-metal pieces would be allowed to fall into a lower bin. It is contemplated that any other sorting method can be used to separate the metal and non-metal pieces.

After the metal and non-metal pieces are sorted, the metal can be recycled. Although it is desirable to perfectly sort the mixed materials, there will always be some errors in the sorting process. The metal sorting algorithm may be adjusted based upon the detector signal strength. A strong signal is a strong indication of metal while a weaker signal is less certain that the detected piece is metal. An algorithm sets a division of metal and non-metal pieces based upon signal strength and can be adjusted, resulting in varying the sorting errors. For example, by setting the metal signal detection level low, more non-metallic pieces will be sorted as metal. Conversely, if the metal signal detection level is high, more metallic pieces will not be separated from the non-metallic pieces. The metal recycling process can tolerate some non-metallic pieces, however this sorting error should be minimized. The end user will be able to control the sorting point and may even use trial and error or empirical result data to optimize the sorting of the mixed materials.

Although the described metal sorting system can have a very high accuracy resulting in metal sorting that is well over 90% pure metal, it is possible to improve upon this performance. There are various methods for improving the metal purity and accurately separating the metallic from non-metallic at an accuracy rate close to 100%. The metal sorted as described above can be further purified by further sorting with an additional recovery unit. The recovery unit is similar to the primary metal sorting processing unit described above. The metal pieces sorted by the primary metal sorting unit are placed onto a second conveyor belt and passed close by additional arrays of inductive proximity detectors in the recovery unit. These recovery unit detector arrays can be configured as described above: with mixed shielded and unshielded detectors, alternating operating frequencies for oscillator detectors, staggered rows for coil and/or oscillator detectors and arrays mounted both over and under the conveyor belt.

Like the primary sorting unit, the outputs of the inductive proximity detectors are fed to a computer which tracks the metal pieces. The computer transmits signals to the sorting mechanism to again separate the metal and nonmetal pieces into different bins at the end of the conveyor belt. In the preferred embodiment, the sorting system used with the recovery unit has air jets mounted under the upper surface of the conveyor belt. The air jets are not actuated when the non-metal pieces arrive at the end of the conveyor belt and they fall into the non-metal bin adjacent to the end of the conveyor. The recovery computer sends signals actuating the air jets when metal pieces arrive at the end of the conveyor belt deflecting them over a barrier into a metal bin. These under mounted air jets are preferred because the metal tends to be heavier and thus has more momentum to travel further to the metal bin than the lighter non-metal pieces. The resulting metal pieces in the metal bin of the recovery unit are at a very high metal purity of up to 99% and can be recycled without any possible rejection due to low purity.

Because the majority of the parts being sorted by the recovery unit are metal, there will be much fewer pieces sorted into the non-metal bin than the metal bin. Because there will be some metal pieces in the non-metal bin and the total volume will be substantially smaller than that in the metal bin, the pieces in the non-metal bin may be placed back onto the recovery unit conveyor belt and resorted. By passing the non-metals through the recovery unit multiple times, any metal pieces in this material will eventually be detected and placed in the metal bin. This processing insures the accuracy of the metal and non-metal sorting.

In addition to sorting metals from non-metals, there is also a need to sort stainless steel from other metals. While the majority of recycled metals are currently consumed by China and India, these countries are not yet able to efficiently recycle stainless steel. As a result of this inability, the price of scrap stainless is currently higher in Japan and the US than it is in China or India. Of the metal that is typically sorted within the United States, about 50% is stainless steel, while the other 50% is all other types of metals. When a Chinese recycling plant receives a shipment of mixed metals, they manually remove the stainless steel pieces from the other metals. The stainless steel is then sold to Japan or back to the US. Because China does not currently process stainless steel, the purchasing price for stainless will be higher in the US and Japan than China or India. Because of the inefficiency of selling mixed metals and then sorting the stainless steel from the mixed metals, there is a great need for a stainless steel sorting system.

Figure 8:
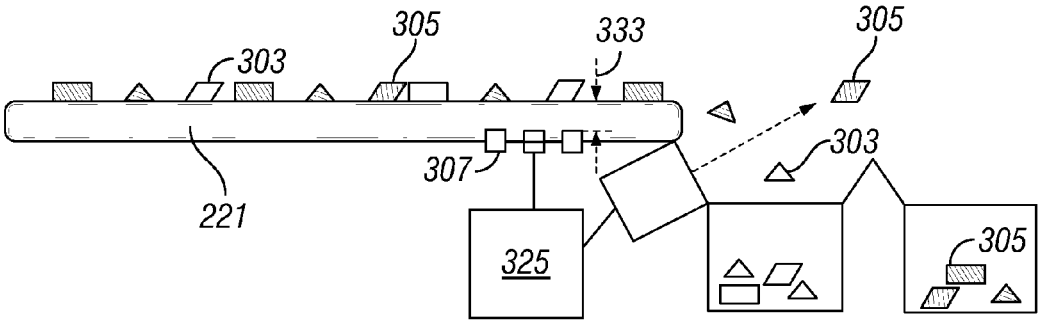
FIG. 8 illustrates a side view of the conveyor belt with a metal sorting system.

There are different ways of detecting the stainless steel mixed together with other metal pieces. The stainless steel/other metal sorting is performed after the metal/non-metal sorting. With reference to FIG. 8, the inductive proximity detectors 307 can be used to distinguish stainless steel 107 from the mixed metal pieces 105. As discussed, some inductive proximity detectors 307 are particularly sensitive to specific types of metals which is characterized by the detector's correction factor. The correction factor is a comparison between the detector's sensitivity to various metals in comparison to stainless, i.e., the correction factor for stainless steel will always be 1.00. In this application, an inductive proximity detector should be used which has very low correction factor for all other metals. As discussed, the correction factor is applied to the penetration rating of the sensor. An array of sensors 307 is placed under the conveyor belt 221 and positioned such that the penetration distance for stainless steel is greater than the distance 333 between the sensors 307 and the top surface of the conveyor belt 221. The sensors 307 should also be positioned so that the penetration distance for all other metals is smaller than the distance between the sensors 307 and the top of the conveyor belt 221. This configuration allows the sensors 307 to detect stainless steel on the conveyor belt 221 but not detect any other types of metals 303. The computer 325 identifies the stainless pieces 305 by identifying and determining when and where the stainless pieces 305 reach the end of the conveyor belt 221. The computer 325 instructs the sorting mechanism to separate the stainless steel pieces from all other metal pieces 105. As discussed above, the sorting mechanism can be an array of air jets 551 mounted above or below the conveyor belt 221.

Figure 9:
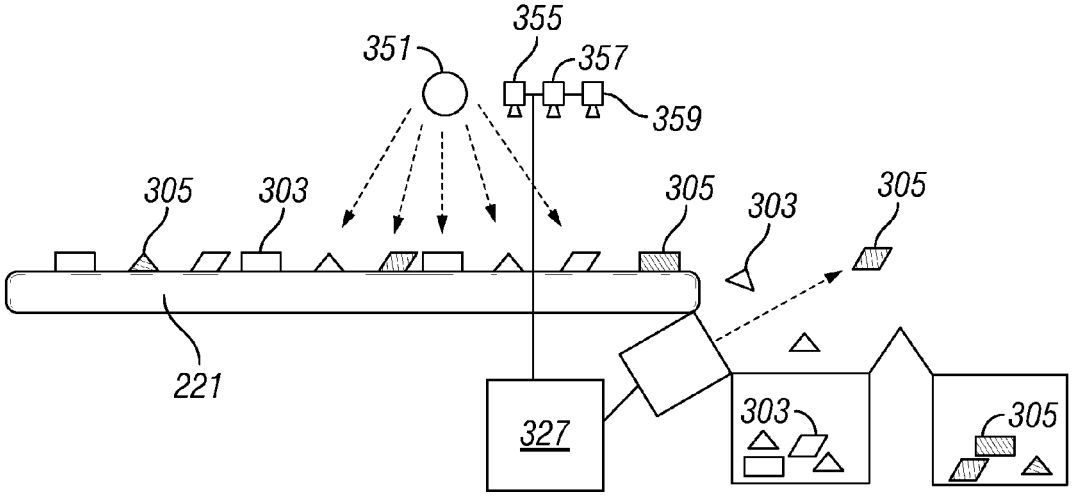
FIG. 9 illustrates a side view of the conveyor belt with a metal sorting system.

Alternatively, an optical system can be used to detect and sort stainless steel from other types of metals. With reference to FIG. 9, a white light 351 is shined down onto the metal pieces 303, 305 on a moving conveyor belt and optical detectors 355 also mounted above the conveyor belt 221 are used to measure the intensity of the reflected light. A first optical detector 355 measures the reflected intensity of red light, a second optical detector 357 measures the reflected intensity of blue light and a third optical detector 359 measures the reflected intensity of green light. The outputs of the optical detectors 355, 357, 359 are signals that represent the detected optical intensities and are forwarded to a computer 327 that processes the detected intensity signals. The computer 327 uses an algorithm to determine if each piece is stainless steel or not. The algorithm is $(I_{red} \times I_{blue})/(I_{green})^2$. The stainless steel pieces 305 will have a specific range of values while all non-stainless pieces 303 will have different ranges of values. Stainless is sometimes referred to as a "white" metal while other metals that contain copper are called "red" metals. It is very important to keep the copper away from the stainless steel pieces, as the copper can contaminate the stainless steel if not carefully separated.

There are various types of optical sensors that can be used in this application. In an embodiment, one or more cameras can be used to detect the stainless steel pieces such as a charge-coupled device (CCD). The CCD is the sensor used in digital cameras and video cameras. The CCD is similar to a computer chip, which senses light focused on its surface, like electronic film. Other types of electronic optical sensors include Complementary Metal-Oxide Semiconductor (CMOS). When used with special software running on a computer these optical detectors are capable of distinguishing red, green and blue colors and the associated wavelengths of visible light. Alternatively, several cameras can be used together with a different red, green or blue optical filter. By imaging a surface of the stainless steel pieces and other metal pieces, the camera can identify the locations of the stainless steel pieces.

In an alternative embodiment, optical sensors are used to detect the reflected red, green and blue light. Color filters are used with the optical sensors so that each sensor receives only red, green or blue light. By placing the filtered detectors for each color in close proximity, the relative intensities of the reflected light will be equal for each detector. If the detectors cannot cover the entire width of the conveyor belt, multiple clusters of red, green and blue optical sensors can be configured in an array across the width of the conveyor belt. The groups of optical sensors can be spaced in staggered rows to avoid cross talk.

The computer identifies the stainless steel pieces and tracks their locations based upon the optical data. The computer is connected to a sorting mechanism to separate the stainless steel from the non-stainless steel pieces. As discussed above, the sorting mechanism can be an array of air jets which sort the stainless steel pieces into one bin and the non-stainless steel into a different bin or any other type of sorting mechanism.

In addition to the stainless steel sorting unit, the inventive system can be used to sort other types of metals. These specific metals are detected using optical or electromagnetic sensors and detection algorithms run on a computer. The metals are then sorted as described above. By sorting the metals before they are sold, specific types of metals can be shipped directly to the end user. For example, under current market conditions the stainless steel can be sold domestically and to Japan, while all other metal pieces can be shipped to China or India. With the increased usage of high technology metals such as scandium and titanium the ability to separate specific types of metals will greatly increase.

It will be understood that although the present invention has been described with reference to particular embodiments, additions, deletions and changes could be made to these embodiments, without departing from the scope of the present invention.

What is claimed is:

1. An apparatus for sorting metal, comprising:

a planar surface upon which a plurality of metal pieces are placed, wherein the metal pieces comprise a first size and a second size;

a plurality of shielded inductive proximity sensors mounted in close proximity to the planar surface operable to detect metal pieces of the first size but not metal pieces of the second size;

a plurality of unshielded inductive proximity sensors mounted in close proximity to the planar surface operable to detect metal pieces of the second size; and a sorting device operable to sort the plurality of metal pieces by the first size and the second size based on information from the plurality of shielded inductive proximity sensors and the plurality of unshielded inductive proximity sensors;

wherein at least one of the plurality of shielded inductive proximity detectors operates at a first frequency and another of the plurality of shielded inductive proximity detectors operates at a second frequency or at least one of the plurality of unshielded inductive proximity detectors operates at the a frequency and another of the plurality of unshielded inductive proximity detectors operates at a second frequency.

2. The apparatus of claim 1 further comprising a computer connected to the plurality of shielded inductive proximity sensors and the plurality of unshielded inductive proximity sensors and operable to detect the locations of the metal pieces on the planar surface.

3. The apparatus of claim 1 further comprising a display device connected to the inductive proximity sensor and operable to display information about the metal pieces that have been detected.

4. The apparatus of claim 1 wherein the plurality of unshielded inductive proximity detectors are mounted in a staggered configuration across a width of the planar surface.

5. The apparatus of claim 1 wherein the plurality of shielded inductive proximity detectors are arranged in a linear manner across a width of the planar surface and adjacent shielded inductive sensors operate at different frequencies.

6. The apparatus of claim 1 wherein the plurality of shielded inductive proximity detectors or the plurality of unshielded inductive proximity detectors are mounted both below the planar surface and above the planar surface.

7. The apparatus of claim 1 wherein the plurality of unshielded inductive proximity detectors are arranged in a linear manner across a width of the planar surface and adjacent unshielded inductive sensors operate at different frequencies.

8. The apparatus of claim 1 wherein the sorting device comprises an array of air jets to separate the metal pieces from the mixed material pieces.

* * * * *